US006273013B1

(12) United States Patent
Carey, Jr.

(10) Patent No.: US 6,273,013 B1
(45) Date of Patent: Aug. 14, 2001

(54) THREAD TAIL CONTROL APPARATUS AND METHOD

(75) Inventor: Snead Henry Carey, Jr., Roxbro, NC (US)

(73) Assignee: L&P Property Management Company, South Gate, CA (US)

( * ) Notice: Subject to any disclaimer, the term of this patent is extended or adjusted under 35 U.S.C. 154(b) by 0 days.

(21) Appl. No.: 09/523,867

(22) Filed: Mar. 14, 2000

(51) Int. Cl.[7] ..... D05B 11/00; D05B 29/06

(52) U.S. Cl. ..... 112/117; 112/235; 112/302; 112/475.08

(58) Field of Search ..... 12/235, 236, 286, 12/117, 285, 287, 288, DIG. 1–DIG. 3, 475.08

(56) References Cited

U.S. PATENT DOCUMENTS

| | | | | |
|---|---|---|---|---|
| 3,371,632 | * | 3/1968 | Snyder et al. | 112/286 X |
| 3,490,403 | | 1/1970 | Boucraut . | |
| 3,614,935 | * | 10/1971 | Conti | 112/286 |
| 3,698,336 | | 10/1972 | Launer . | |
| 3,802,362 | | 4/1974 | Daniel et al. . | |
| 3,922,983 | * | 12/1975 | Schips et al. | 112/DIG. 1 |
| 4,149,478 | | 4/1979 | Sanvito et al. . | |
| 4,187,793 | | 2/1980 | Fietta et al. . | |
| 4,328,758 | | 5/1982 | Souza et al. . | |
| 4,599,960 | | 7/1986 | Brusasca et al. . | |
| 4,599,961 | | 7/1986 | Brusasca et al. . | |
| 4,796,552 | | 1/1989 | Adamski, Jr. . | |
| 5,613,454 | | 3/1997 | Adamski, Jr. et al. . | |
| 5,655,470 | * | 8/1997 | Tajima et al. | 112/236 |
| 5,927,221 | * | 7/1999 | Porter et al. | 112/DIG. 3 |

* cited by examiner

*Primary Examiner*—Ismael Izaguirre
(74) *Attorney, Agent, or Firm*—Wood, Herron & Evans, L.L.P.

(57) ABSTRACT

An apparatus for removing a thread tail from a hole in a presser foot on a quilting machine. The apparatus has an orifice providing a stream of pressurized air that applies a force against a section of the thread tail extending between the needle and the hole in the presser foot. The pressurized air stream pulls the thread tail through the hole in the presser foot and gathers the thread tail on an upper side of the presser foot. In another embodiment, the present invention includes a method of automatically applying a generally transverse force to a portion of the thread tail extending between the needle and the hole in the presser foot for a duration sufficient to remove the thread tail from the hole in the presser foot.

13 Claims, 2 Drawing Sheets

THREAD TAIL CONTROL APPARATUS AND METHOD

FIELD OF THE INVENTION

The present invention relates to quilting machines, and particularly to an apparatus and a method of controlling a tail of a cut thread.

BACKGROUND OF THE INVENTION

In sewing machines of various types, threads are applied and manipulated on opposite sides of a fabric to form one or more patterns of stitches. The proper formation of the stitches of each series requires the cooperative movement and precise timing of cooperating stitching elements. At the end of a stitching pattern, the thread is cut; and the relative position of the fabric and the stitching elements is changed to sew another stitching pattern. Referring to FIG. 5, layers of fabric 20 to be stitched are laid out on top of a needle plate 22 of a quilting machine. A needle 24 is connected to a needle drive and mounted above a presser foot 28 in a known manner. The presser foot 28 is a bowl-type presser foot which is mounted by means of a support 29 to other components of the quilting machine in a known manner. The needle 24 and thread 25 reciprocate vertically through a hole 26 in the bowl-type presser foot 28, through the layers of fabric 20 and then through a hole 30 of the needle plate 22, thereby forming stitching 32 within the fabric. After a pattern has been stitched, the thread 25 is cut by a known thread cutting device (not shown) normally located below the needle plate 22. Thereafter, the relative position between the layered fabric 20 and the needle 24, presser foot 28 and needle plate 22 is changed to position the needle 24 with respect to the start of another pattern to be stitched.

As the fabric 20 is moved with respect to the needle plate 28 as shown in phantom in FIG. 5, the thread tail 34 is pulled to a location between the layered fabric 20 and the presser foot 28. When that desired relative position between the layered fabric 20 and the presser foot 28 is achieved, the stitching cycle is again initiated, and as the needle 24 passes through the fabric 20, the thread tail 34 remains locked under the presser foot 28. When that stitching pattern is completed and the layered fabric again moves with respect to the presser foot, the thread tail 34 hangs from the upper surface 36 of the layered fabric 20 and requires manual trimming.

Therefore, there is a need to improve the process so that the manual trimming of thread tails is not required.

SUMMARY OF INVENTION

The present invention provides a method and apparatus that substantially improves the efficiency of a process of sewing layered fabric on a quilting machine. The method and apparatus of the present invention is valuable in reducing the cost of sewing layered fabric on a quilting machine by eliminating a labor intensive and time consuming manual operation. Thus, the method an apparatus of the present invention provides a more consistent, efficient and higher quality quilting machine operation and product therefrom.

In accordance with the principles of the present invention and the described embodiments, an apparatus is provided for removing a thread tail from a hole in a presser foot on a quilting machine. The apparatus has an orifice providing a stream of pressurized air capable of applying a force against a section of the thread tail extending between the needle and the hole in the presser foot. The pressurized air stream pulls the thread tail through the hole in the presser foot and gathers the thread tail on an upper side of the presser foot. The apparatus further has a valve for turning the stream of pressurized air on and off.

In another embodiment, the present invention includes a method of automatically applying a generally transverse force to a portion of the thread tail extending between the needle and the hole in the presser foot for a duration sufficient to remove the thread tail from the hole in the presser foot.

In one aspect of the invention, the thread tail extends through the hole in the presser foot and through the layered fabric material being sewn, and the method further comprises maintaining the pressurized air stream for a duration such that all of the thread tail is pulled from the layer fabric material and through the hole in the presser foot.

Thus, the apparatus of the present invention has the advantage of eliminating the labor intensive, time consuming, and expensive manufacturing operation of manually trimming hanging thread tails from the sewn fabric. The apparatus of the present invention controls the thread tail in a manner that permits the thread tail to be sewn into the layered fabric during a further stitching operation.

Various additional advantages, objects and features of the invention will become more readily apparent to those of ordinary skill in the art upon consideration of the following detailed description of the presently preferred embodiments taken in conjunction with the accompanying drawings.

DETAILED DESCRIPTION OF THE INVENTION

Figure 1:
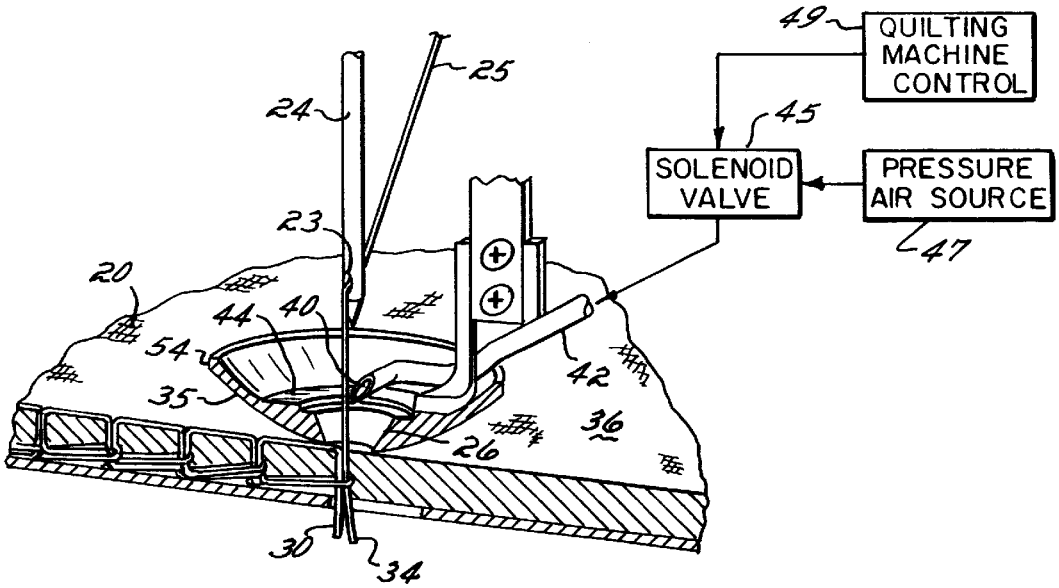
FIG. 1 is a partial sectioned perspective view of a presser foot and other stitching elements of a quilting machine in accordance with the principles of the present invention.
Figure 2:
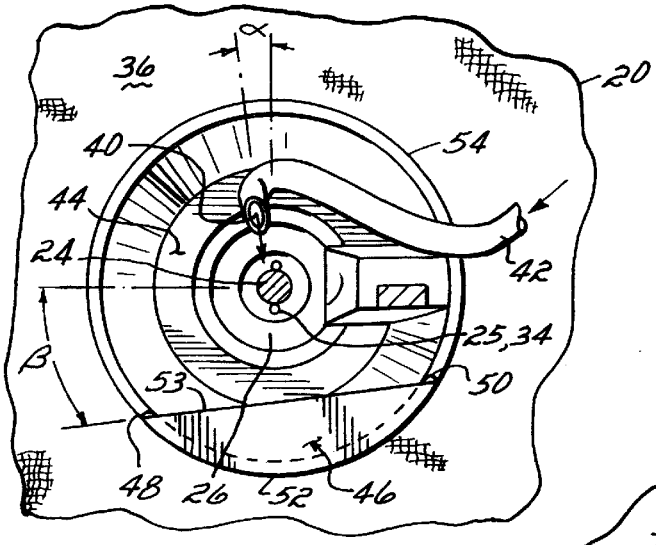
FIG. 2 is a partial top view of the presser foot of FIG. 1 with a thread tail beneath the presser foot.

Referring to FIGS. 1 and 2, as the layered fabric 20 changes position with respect to the presser foot 28, the thread tail 34 is captured between a lower surface 35 of the presser foot 28 and the top surface 36 of the layered fabric 20. As previously discussed, in the absence of the invention, subsequent stitching by the needle 24 will result in the thread tail 34 hanging from the surface 36. Thus, with each pattern stitched, the thread tail 34 must be manually trimmed and removed.

In order to eliminate the hanging thread tail 34, the present invention utilizes an air jet from an orifice 40 at one end of a tube 42. As shown in FIG. 2, the orifice 40 of the tube 42 is oriented to direct a stream of pressurized air 43 substantially diametrically across the hole 26 of the presser foot 28. The tube 42 has a nominal inside diameter of 0.0625 inches and is made from any suitable material, for example, a malleable soft copper, brass, steel, plastic, etc. The other end of the tube 42 is connected to a valve 45 that, in turn, is fluidly connected to a source of pressurized air 47. The operation of the valve 45 is controlled by a quilting machine control 49 as will be subsequently described. The pressurized air stream from the orifice 40 applies a sufficient force on the thread 34 to move the thread tail 34 to a location on an upper side of the presser foot 28. The pressurized stream of air 43 is maintained for a sufficient duration to pull the full length of the thread tail 34 upward through the hole 26 of the presser foot 28.

Figure 3:
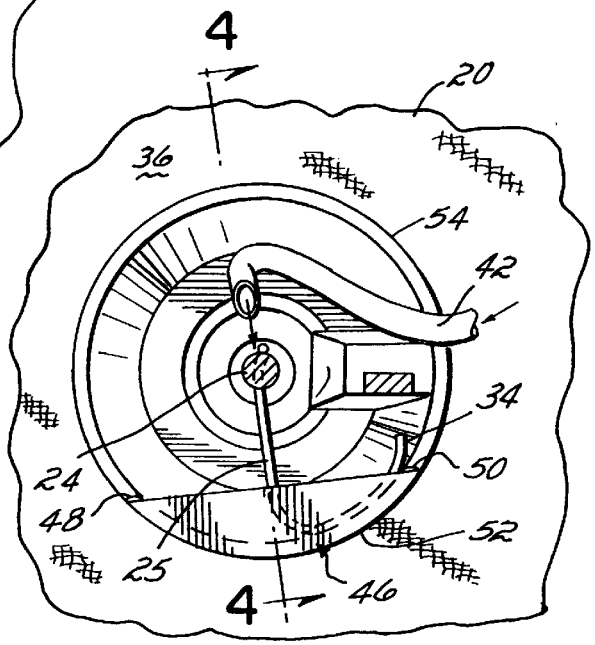
FIG. 3 is a partial top view of the presser foot of FIG. 1 with the thread tail removed from beneath the presser foot.
Figure 4:
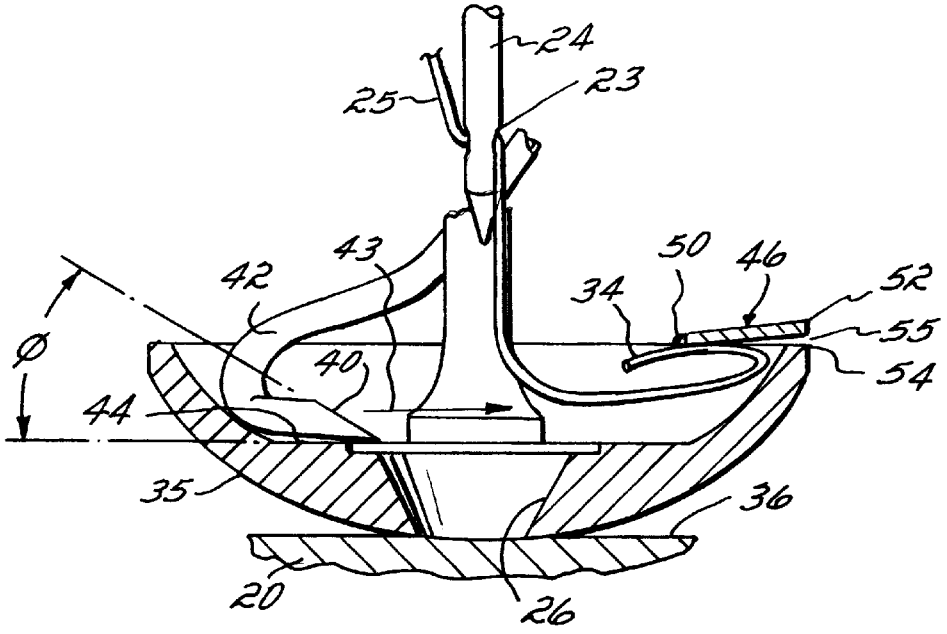
FIG. 4 is a cross-sectional view taken along line 4—4 of FIG. 3.
Figure 5:
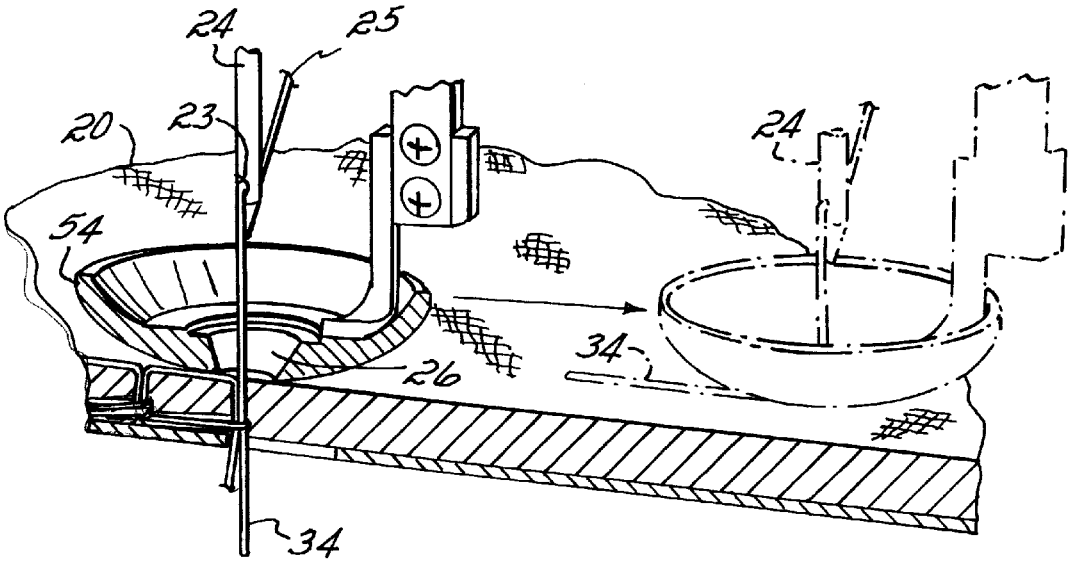
PRIOR ART FIG. 5
FIG. 5 is a partial sectioned perspective view of a prior art presser foot and other stitching elements of a quilting machine.

Referring to FIGS. 2–4, a baffle 46 is mounted on the presser foot 28. The baffle 46 has an outer edge 52 with an arcuate profile that matches the circular profile of the outer peripheral edge 54 of the presser foot 28. The baffle 46 has an inner edge 53 that is substantially linear and extends between the ends 48, 50 of the outer edge 52, thereby forming a substantially crescent-shaped baffle 46. The baffle 46 is attached to the peripheral edge 54 of the presser foot 28 at the ends 48, 50 by an appropriate process, for example, welding, brazing, etc. Thus, referring to FIG. 4, the arcuate edge 52 of the baffle 46 is unattached to, and forms a small gap 55 with, the peripheral edge 54 of the presser foot 28. The gap 55 is, for example, approximately 0.030 inches. Consequently, the gap provides a path for the pressurized air stream 43 from the orifice 40 in a manner to facilitate the lifting of the thread tail above the presser foot 28.

In the illustrated embodiment of FIGS. 2–4, the baffle plate is mounted on the peripheral edge 54 of the presser foot 28 such that the inner edge 53 of the baffle plate 46 forms an angle a of approximately 9° rotated counterclockwise from a first diameter 57 coincident with a centerline of the mounting bracket 29. The tube 42 is mounted within the presser foot 28 such that the pressurized air stream is directed out of the orifice 40 at an angle β of approximately 5° rotated counterclockwise from a second diameter substantially perpendicular to the first diameter. It should be noted, however, that those angles are not critical to the operation of the invention. Normally, the pressurized air stream from the orifice 40 should be directed along a path that is approximately perpendicular to the inner edge of baffle plate 46.

Care should also be taken that the pressurized air stream does blow the thread 25 out of the eye 23 from the needle 24 (FIG. 1). Therefore, the pressurized air stream from the orifice 40 should be directed at the needle 24 in the same direction as the thread 25 passes through the needle. In other words, the pressurized air stream from the orifice 40 should be directed generally at the side of the eye 23 of the needle 24 that receives the thread 25.

The baffle 46 functions to direct the pressurized air stream across the presser foot 28 in a direction moving the thread tail 34 to the interior of the presser foot 28 as shown in FIGS. 3 and 4. Hence, the thread tail 34 is loosely gathered on top of the presser foot 28 and is not locked between the lower surface 35 of the presser foot 28 and the upper surface 36 of the layered fabric 20. Therefore, when stitching is again initiated, the needle 24 sews both the thread 25 and the thread tail 34 into the layered fabric 20. Thus, the thread tail 34 is sewn into the layered fabric 20 and there is no requirement for trimming the thread tail 34 after the pattern is stitched. Referring to FIG. 4, normally, the orifice 40 at the end of the tube 42 is uncut in a plane having an angle ϕ of approximately 30° with the bottom surface 44 of the presser foot 28.

In use, the process of capturing the thread tail 34 on the upper side of the presser foot 28 is commanded by the quilting machine control 49 and is executed in association with a trim cycle that cuts the thread 25 in a known manner. At substantially the same time that the quilting machine control 49 provides an output signal to a knife commanding the knife to cut the thread, the quilting machine control 49 provides a signal over an output 51 to a valve 45, for example, an electrically operated solenoid valve, causing the valve 45 to switch to an open state. In the open state, the valve 45 permits the pressurized air to flow from the source 47 through the fluid path formed by the tube 42 and out the orifice 40. A timer within the quilting machine control 49 is also started so that the valve 45 remains open for a period of time, for example, 2–5 seconds. The pressure magnitude of the pressurized air and the duration of the timer must be sufficient to allow the force of the air stream 43 on the recently cut thread tail 34 to pull the full length of the thread tail 34 through the layered cloth 20 and the hole 26 of the presser foot 28. When the timer in the control 49 expires, the quilting machine control 49 switches the state of the signal on its output 51, thereby switching the state of the valve 45 and terminating the flow of pressurized air from the source 47 and out the orifice 40 of the tube 42. Therefore, when the machine starts its next stitching cycle, the cut thread tail 34 is not trapped by the presser foot, but instead, is gathered loosely on top of the presser foot 28. And, the needle 25 sews the thread tail 34 into the layered fabric 20, leaving no tail from the top surface 36 and only a small knot on the opposite side of the fabric.

The pressurized air stream 43 of the present invention moves the thread tail to a location in which the tail 34 is not clamped by the presser foot 28, but is free to be sewn in the layered fabric by subsequent stitching. By maintaining such control of the thread tail, the labor-intensive, time-consuming and expensive process of having to manually trim thread tails from each of the patterns stitched is eliminated. Thus, the invention reduces the labor content, the time of manufacturing, and it presents a substantial cost savings to the manufacturer.

While the present invention has been illustrated by a description of one embodiment and while that embodiment has been described in considerable detail, it is not intended to restrict or in any way limit the scope of the appended claims to such detail. Additional advantages and modifications within the spirit and scope of the invention will readily appear to those skilled in the art. For example, in the described embodiment, the thread tail 34 is removed from the fabric at the end of a stitching pattern and before the relative position between the layered fabric 20 and the presser foot 28 is changed. Obviously, it is easier to move the thread tail 34 to the upper side of the presser foot prior to the thread tail becoming pulled beneath the presser foot 28. However, as will be appreciated, the thread tail may be moved at a different time in the stitching cycle, and the thread tail may be also pulled from between the lower side of the presser foot and the upper surface of the layered fabric.

Further, in the described embodiment, the presser foot 28 is shown and described as a bowl-type presser foot. As will be appreciated, the invention is applicable to other types of a presser foot, for example, a flat presser foot. Regardless of its design, the presser foot should have a size that permits the thread tail to be moved to the top of the presser foot, so that it is not subject to being trapped between a lower side of the presser foot and the fabric. In addition, while the described embodiment shows a single needle, as will be appreciated, the thread tail control of the present invention may be applied to machines having any number of needles.

In addition, the orifice 40 is described as being circular. As will be appreciated, the orifice 40 may be elliptical or any other geometric shape. Further, in the described embodiment, the orifice 40 is described as having a nominal inside diameter of 0.0625 inches. However, as will be appreciated, the orifice 40 may be smaller or larger.

The described embodiment recites specific values for the angles $\alpha$, $\beta$, $\phi$, the gap between the baffle plate outer edge 52 and the peripheral edge 54 of the presser foot 28 and the time duration of the air stream. As will be appreciated those are values that have been chosen for a presser foot of a specific design in a particular application. Depending on the size and geometry of the presser foot 28 and other application related conditions, other values for those variables may be used; and further, some experimentation with respect to those variables may be required to achieve the desired results.

The invention is particularly suitable for use on multi-needle quilting machines such as described, for example, in commonly assigned U.S. Pat. Nos. 5,154,130 and 5,544,599, hereby expressly incorporated herein by reference. The invention is also useful on single needle quilting machines as, for example, described in commonly assigned U.S. Pat. Nos. 5,650,916, 5,685,250 and 5,832,849, hereby expressly incorporated by reference herein. The thread tail control is particularly suited for use at the start of the quilting of a pattern.

Therefore, the invention in its broadest aspects is not limited to the specific detail shown and described. For example, the invention may be useful in other non-quilting sewing applications. Consequently, departures may be made from the details described herein without departing from the spirit and scope of the claims which follow.

What is claimed is:

1. An apparatus for controlling a thread tail extending from a needle through a hole in a presser foot on a quilting machine, the apparatus comprising:

an orifice providing a stream of pressurized air capable of applying a force against a section of the thread tail extending between the needle and the presser foot, thereby pulling the thread tail through the hole in the presser foot and gathering the thread tail on an upper side of the presser foot;

a valve for turning the stream of pressurized air on and off;

a source of pressurized air;

an air valve fluidly coupled to the source;

a fluid path extending between the valve and the orifice; and the presser foot having an outer peripheral edge and the apparatus further comprises a baffle plate extending around a portion of the outer peripheral edge.

2. The apparatus of claim 1 wherein the baffle plate has an inner edge extending between two points on the peripheral edge of the presser foot.

3. The apparatus of claim 2 wherein the orifice directs the stream of pressurized air in a substantially perpendicular direction toward the inner edge of the baffle plate.

4. The apparatus of claim 3 wherein the presser foot has a flat bottom surface and the orifice has an opening in a plane extending upward at an angle of substantially 30° with respect to the flat bottom surface of the presser foot.

5. The apparatus of claim 2 wherein the inner edge of the baffle plate is substantially transverse to the stream of pressurized air.

6. The apparatus of claim 5 wherein the baffle plate has an outer edge substantially matching the peripheral edge of the presser foot.

7. The apparatus of claim 6 wherein the inner edge of the baffle plate is substantially linear and intersects the outer edge at its ends.

8. The apparatus of claim 7 wherein the outer edge of the baffle plate and the peripheral edge of the presser foot are arcuate in shape.

9. The apparatus of claim 7 wherein the baffle plate is attached to the presser foot at the ends of the outer edge.

10. The apparatus of claim 7 wherein the baffle plate is attached to the presser foot only at the ends of the outer edge.

11. The apparatus of claim 10 wherein the outer peripheral edge of the presser plate and the outer edge of the baffle plate are substantially circular and the baffle plate is substantially crescent shaped.

12. The apparatus of claim 11 wherein the fluid path extending between the valve and the orifice is made from a formable tubing.

13. A method of controlling a tail of a top thread after quilting a pattern on a multilayered fabric on a quilting machine, trimming the top thread and repositioning the needle relative to the fabric to begin the quilting of another pattern on the fabric so as to prevent a trailing of the tail of the top thread over the face of the fabric upon the quilting of said another pattern, the method comprising:

with the needle withdrawn from a hole in a pressure foot, the pressure foot raised from the fabric, and the tail of the top thread extending from the needle on the back side of the pressure foot, through the hole in the pressure foot to the fabric side of the pressure foot:

directing a stream of pressurized air across the back side of the pressure foot and transversely against a section of the tail of the top thread that extends between the needle and the hole in the presser foot;

maintaining the stream of pressurized air onto the section of the thread tail for a period of time sufficient to pull all of the tail of the top thread through the hole to the needle side of the pressure foot; and thereafter, terminating the stream of pressurized air onto the section of the thread tail;

initiating the quilting of said another pattern on the fabric by extending the needle through the hole in the pressure foot and through the fabric with the top thread extending through the hole in the pressure foot and into the fabric and with the tail of the top thread extending generally parallel to needle from the fabric side of the pressure foot and through the hole in the pressure foot to the back side of the pressure foot; and continuing the quilting of said another pattern until the entire tail of the top thread is pulled through the hole in the pressure foot and stitched along with said another pattern to the fabric;

thereby preventing the trailing of the top thread upon the quilting of said another pattern.

* * * * *

UNITED STATES PATENT AND TRADEMARK OFFICE

CERTIFICATE OF CORRECTION

PATENT NO. : 6,273,013 B1 
DATED : August 24, 2001
INVENTOR(S) : Snead Henry Carey, Jr.

It is certified that error appears in the above-identified patent and that said Letters Patent is hereby corrected as shown below:

Column 1,
Line 58, change "the method an apparatus" to -- the method and apparatus --.

Column 2,
Line 15, change "pulled from the layer fabric" to -- pulled from the layered fabric --.
Line 62, change "diameter of 0.0625 inches" to -- diameter of 0.0625 inch --.

Column 3,
Line 20, change "approximately 0.030 inches" to -- approximately 0.030 inch --.
Line 27, change "an angle a of approximately" to -- an angle α of approximately --.
Line 40, change "does blow the thread" to -- does not blow the thread --.

Column 5,
Line 2, change "diameter of 0.0625 inches" to -- diameter of 0.0625 inch --.

Column 6,
Line 17, change "presser plate" to -- presser foot --.
Line 20, change "The apparatus of claim 11 wherein" to -- The apparatus of claim 1 wherein --.
Lines 30, 31, 33, 34, 36, 42, 47, 48, 51, 52, 53 and 56, change "pressure foot" to -- presser foot --.

Signed and Sealed this

Twelfth Day of August, 2003

JAMES E. ROGAN
*Director of the United States Patent and Trademark Office*